US009514690B2

(12) United States Patent
Kim et al.

(10) Patent No.: US 9,514,690 B2
(45) Date of Patent: Dec. 6, 2016

(54) LIQUID CRYSTAL DISPLAY

(75) Inventors: Sunyoung Kim, Gyeonggi-do (KR); Kiduk Kim, Gyeonggi-do (KR); Sunhwa Lee, Gyeonggi-do (KR); Byounggwan Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1310 days.

(21) Appl. No.: 12/778,641

(22) Filed: May 12, 2010

(65) Prior Publication Data

US 2011/0141003 A1 Jun. 16, 2011

(30) Foreign Application Priority Data

Dec. 11, 2009 (KR) ..... 10-2009-0123188

(51) Int. Cl.
*G09G 3/34* (2006.01)
*G09G 3/36* (2006.01)

(52) U.S. Cl.
CPC ..... *G09G 3/342* (2013.01); *G09G 3/3666* (2013.01); *G09G 2310/024* (2013.01); *G09G 2310/0237* (2013.01); *G09G 2310/0283* (2013.01); *G09G 2320/0261* (2013.01); *G09G 2320/064* (2013.01)

(58) Field of Classification Search
USPC ..... 315/158, 291; 345/1.1, 32, 82, 88, 96, 345/98, 102–103, 213–214, 629; 348/333.05, 771; 349/77; 353/122; 362/97.1; 370/280; 250/484.5
See application file for complete search history.

(56) References Cited

U.S. PATENT DOCUMENTS

2004/0041760 A1 3/2004 Tsumura et al.
2004/0251854 A1* 12/2004 Matsuda et al. ..... 315/291
2004/0257302 A1* 12/2004 Ilyanok ..... 345/32
(Continued)

FOREIGN PATENT DOCUMENTS

CN 1713031 A 12/2005
CN 1734539 A 2/2006
(Continued)

OTHER PUBLICATIONS

Chinese Office Action (Application No. 201010285308.7), dated Jul. 11, 2012.
(Continued)

*Primary Examiner* — Lin Li
(74) *Attorney, Agent, or Firm* — Morgan, Lewis & Bockius LLP

(57) ABSTRACT

A liquid crystal display includes a liquid crystal display panel that is divided into a first display surface and a second display surface including data lines and gate lines, a first data driving circuit configured to drive data lines of the first display surface, a second data driving circuit configured to drive data lines of the second display surface, a gate driving circuit configured to sequentially supply a gate pulse for scanning the first display surface to gate lines of the first display surface and sequentially supply a gate pulse for scanning the second display surface to gate lines of the second display surface, a timing controller configured to divide a unit frame period into a first sub-frame period and a second sub-frame period, a backlight unit configured to provide light to the liquid crystal display panel wherein the backlight unit includes a plurality of light sources, and a light source driving circuit configured to turn off all the plurality of light sources during the first sub-frame period and turn on all the plurality of light sources at a turn-on time within the second sub-frame period.

19 Claims, 10 Drawing Sheets

(56) References Cited

U.S. PATENT DOCUMENTS

| | | | | |
|---|---|---|---|---|
| 2006/0022968 | A1 | 2/2006 | Kondo et al. | |
| 2006/0238486 | A1* | 10/2006 | Hiraki | 345/102 |
| 2007/0035707 | A1* | 2/2007 | Margulis | 353/122 |
| 2007/0152951 | A1* | 7/2007 | Ahn | 345/102 |
| 2007/0229432 | A1 | 10/2007 | Kimura | |
| 2007/0229453 | A1* | 10/2007 | Aratani et al. | 345/102 |
| 2008/0018587 | A1* | 1/2008 | Honbo et al. | 345/102 |
| 2008/0158140 | A1* | 7/2008 | Takatori et al. | 345/102 |
| 2008/0239204 | A1* | 10/2008 | Lee et al. | 349/65 |
| 2009/0224678 | A1* | 9/2009 | Wang | 315/158 |
| 2009/0267879 | A1* | 10/2009 | Masuda | 345/102 |
| 2010/0079655 | A1* | 4/2010 | Eom et al. | 348/333.05 |

FOREIGN PATENT DOCUMENTS

| | | | |
|---|---|---|---|
| CN | 101029986 | A | 9/2007 |
| KR | 10-2007-0072340 | | 7/2007 |
| TW | 200410189 | A | 6/2004 |
| TW | 200643865 | A | 12/2006 |

OTHER PUBLICATIONS

Office Action dated May 31, 2013, from Korean Intellectual Property Office in counterpart Korean application No. 10-2009-0123188.

TIPO: Office Action for Taiwanese Patent Application No. 099116154—Issued on Nov. 20, 2013.

* cited by examiner

LIQUID CRYSTAL DISPLAY

This application claims the benefit of Korean Patent Application No. 10-2009-123188 filed on Dec. 11, 2009, which is incorporated herein by reference.

BACKGROUND OF THE INVENTION

Field of the Invention

The present invention relates to a liquid crystal display, and more particularly to a liquid crystal display capable of improving a motion picture response time (MPRT) performance.

Discussion of the Related Art

An active matrix type liquid crystal display displays a motion picture using a thin film transistor (TFT) as a switching element. The active matrix type liquid crystal display has been implemented in televisions as well as display devices in portable information devices, office equipment, computers, etc., because of its thin profile and high definition. Accordingly, cathode ray tubes are being rapidly replaced by the active matrix type liquid crystal displays.

When a liquid crystal display displays a motion picture, a motion blur resulting in an unclear and blurry screen may appear because of the characteristics of liquid crystals. A scanning backlight driving technology was proposed so as to improve a motion picture response time (MPRT) performance. As shown in FIGS. 1 and 2, the scanning backlight driving technology provides an effect similar to an impulsive drive of a cathode ray tube by sequentially turning on and off a plurality of light sources of a backlight unit along a scanning direction of display lines of a liquid crystal display panel and thus can solve the motion blur of the liquid crystal display. In FIGS. 1 and 2, the black regions show the portions where the light sources are off and the white regions show the portions where the light sources are on. However, the scanning backlight driving technology has the following problems.

First, because the light sources of the backlight unit are turned off for a predetermined time in each frame period in the scanning backlight driving technology, the screen becomes dark. As a solution thereto, a method for controlling the turn-off time of the light sources depending on the brightness of the screen may be considered. However, in this case, the improvement effect of the MPRT performance is reduced because the turn-off time is shortened or removed in the bright screen.

Second, light interference occurs in boundary portions of the scanning blocks because turn-on times or turn-off times of the light sources of the scanning blocks are different from one another in the scanning backlight driving technology.

Third, the formation location of the light sources of the backlight unit are limited because the scanning backlight driving technology can be successfully implemented by controlling light incident on the liquid crystal display panel in each of the scanning blocks. The backlight unit may be classified into a direct type backlight unit and an edge type backlight unit.

In the direct type backlight unit, a plurality of optical sheets and a diffusion plate are stacked under the liquid crystal display panel, and a plurality of light sources are positioned under the diffusion plate. Thus, it is easy to achieve the scanning backlight driving technology in the direct type backlight unit having the above-described structure.

On the other hand, in the edge type backlight unit, a plurality of light sources are positioned opposite the side of a light guide plate, and a plurality of optical sheets are positioned between the liquid crystal display panel and the light guide plate. In the edge type backlight unit, the light sources irradiate light onto one side of the light guide plate and the light guide plate has a structure capable of converting a line light source (or a point light source) into a surface light source. In other words, the characteristics of the light guide plate are such that the light irradiated onto one side of the light guide plate spreads on all sides of the light guide plate. Therefore, it is difficult to control light incident on the liquid crystal display panel in each of the display blocks and hence, it is difficult to achieve the scanning backlight driving technology in the edge type backlight unit having the above-described structure.

SUMMARY OF THE INVENTION

Accordingly, the present invention is directed to a liquid crystal display that substantially obviates one or more problems due to limitations and disadvantages of the related art.

An object of the present invention is to provide a liquid crystal display capable of improving a motion picture response time (MPRT) performance without light interference resulting from a difference between turn-on times or turn-off times of light sources.

Another object of the present invention is to provide a liquid crystal display capable of improving a MPRT performance without a reduction in a luminance of the liquid crystal display.

Another object of the present invention is to provide a liquid crystal display capable of improving a MPRT performance irrespective of locations of light sources constituting a backlight unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal display panel that is divided into a first display surface and a second display surface including data lines and gate lines, a first data driving circuit configured to drive data lines of the first display surface, a second data driving circuit configured to drive data lines of the second display surface, a gate driving circuit configured to sequentially supply a gate pulse for scanning the first display surface to gate lines of the first display surface and sequentially supply a gate pulse for scanning the second display surface to gate lines of the second display surface, a timing controller configured to divide a unit frame period into a first sub-frame period and a second sub-frame period, a backlight unit configured to provide light to the liquid crystal display panel wherein the backlight unit includes a plurality of light sources, and a light source driving circuit configured to turn off all the plurality of light sources during the first sub-frame period and turn on all the plurality of light sources at a turn-on time within the second sub-frame period.

In another aspect, a method of driving a liquid crystal display includes providing light to a liquid crystal display panel that is divided into a first display surface and a second display surface including data lines and gate lines wherein the liquid crystal display panel includes a backlight unit having a plurality of light sources, dividing a unit frame period into a first sub-frame period and a second sub-frame period with a timing controller, and turning off the plurality of light sources during the first sub-frame period and turning on the plurality of light sources at a turn-on time within the second sub-frame period with a light source driving circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
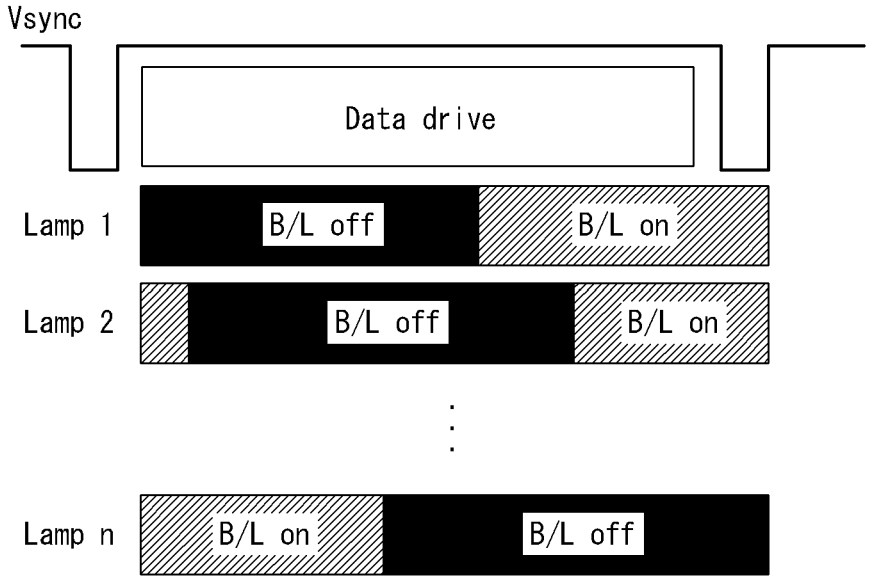
FIG. 1 (Related Art)
FIGS. 1 and 2 illustrate a related art scanning backlight driving technology.
Figure 2:
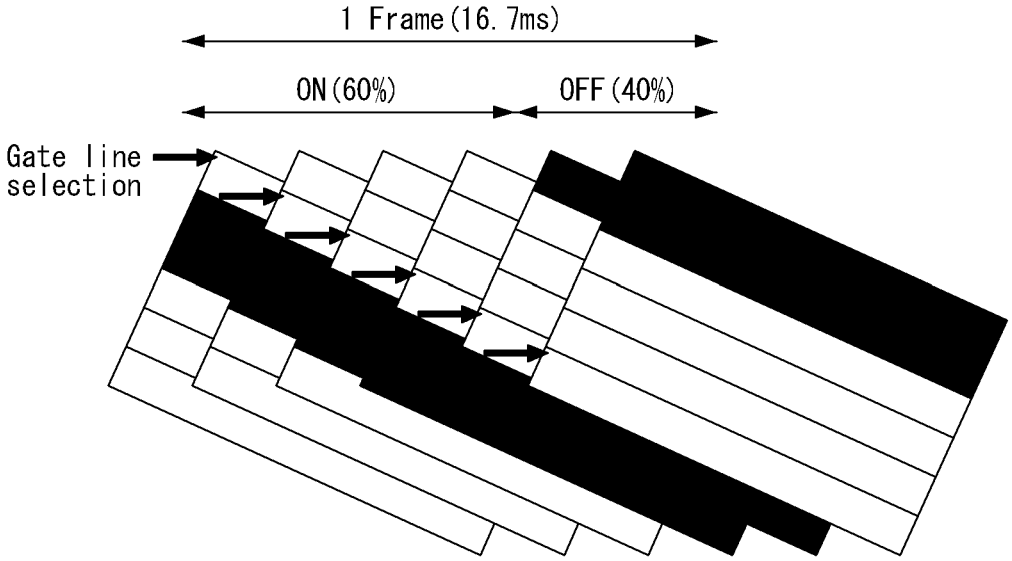
FIG. 2 (Related Art)
Figure 3:
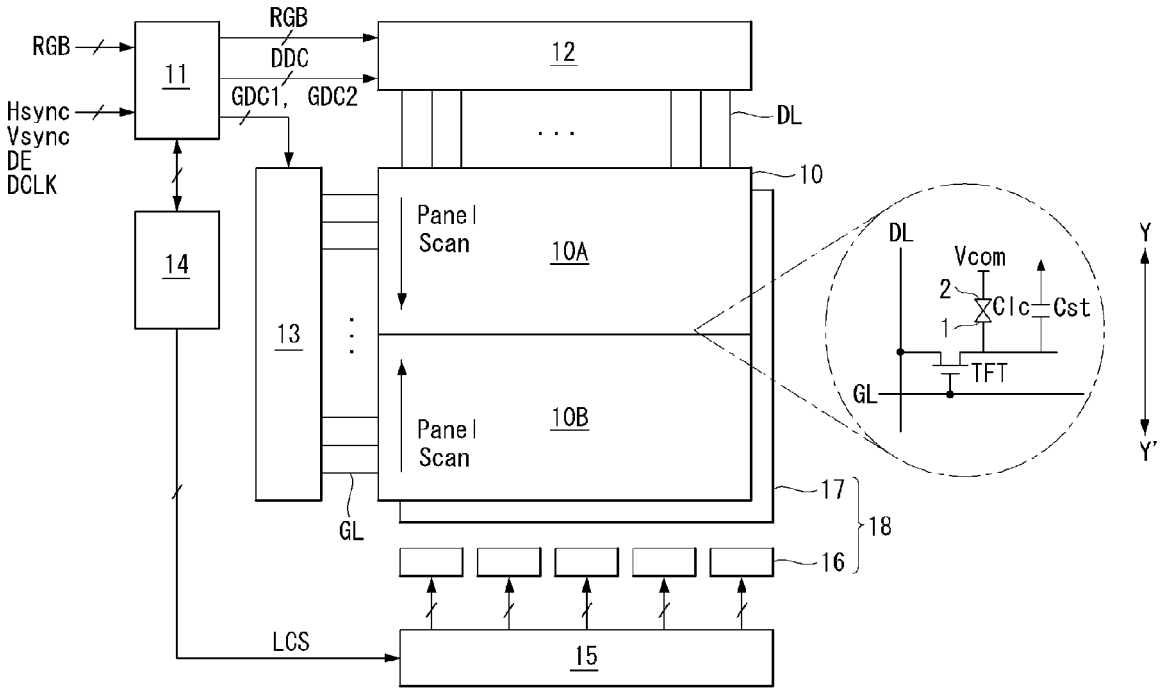
FIG. 3 illustrates a liquid crystal display according to an exemplary embodiment of the invention.

FIG. 3 illustrates a liquid crystal display according to an exemplary embodiment of the invention. As shown in FIG. 3, a liquid crystal display according to an embodiment of the invention includes a liquid crystal display panel 10, a data driving circuit 12 for driving data lines DL of the liquid crystal display panel 10, a gate driving circuit 13 for driving gate lines GL of the liquid crystal display panel 10, a timing controller 11 for controlling the data driving circuit 12 and the gate driving circuit 13, a backlight unit 18 including a plurality of light sources 16 and providing light to the liquid crystal display panel 10, a light source control circuit 14 generating a light source control signal LCS, and a light source driving circuit 15 for driving the plurality of light sources 16 in response to the light source control signal LCS, wherein the light source driving circuit is capable of turning on and off all of the light sources 16 in a blinking manner.

The liquid crystal display panel 10 includes an upper glass substrate (not shown), a lower glass substrate (not shown), and a liquid crystal layer (not shown) between the upper and lower glass substrates. The plurality of data lines DL and the plurality of gate lines GL cross one another on the lower glass substrate of the liquid crystal display panel 10. A plurality of liquid crystal cells Clc are arranged on the liquid crystal display panel 10 in a matrix form in accordance with the data lines DL and the gate lines GL crossing each other. Thin film transistors TFT, pixel electrodes 1 of the liquid crystal cells Clc connected to the thin film transistors TFT, storage capacitors Cst are formed on the lower glass substrate of the liquid crystal display panel 10. The liquid crystal display panel 10 is divided into a first display surface 10A and a second display surface 10B along a vertical direction.

A black matrix (not shown), a color filter (not shown), and a common electrode 2 are formed on the upper glass substrate of the liquid crystal display panel 10. The common electrode 2 can be formed on the upper glass substrate in a vertical electric field driving manner, such as a twisted nematic (TN) mode and a vertical alignment (VA) mode. The common electrode 2 and the pixel electrode 1 can be formed on the lower glass substrate in a horizontal electric field driving manner, such as an in-plane switching (IPS) mode and a fringe field switching (FFS) mode. Polarizing plates (not shown) are respectively attached to the upper and lower glass substrates of the liquid crystal display panel 10. Alignment layers (not shown) for setting a pre-tilt angle of liquid crystals are respectively formed the inner surfaces of the upper and lower glass substrates contacting the liquid crystals.

Figure 4:
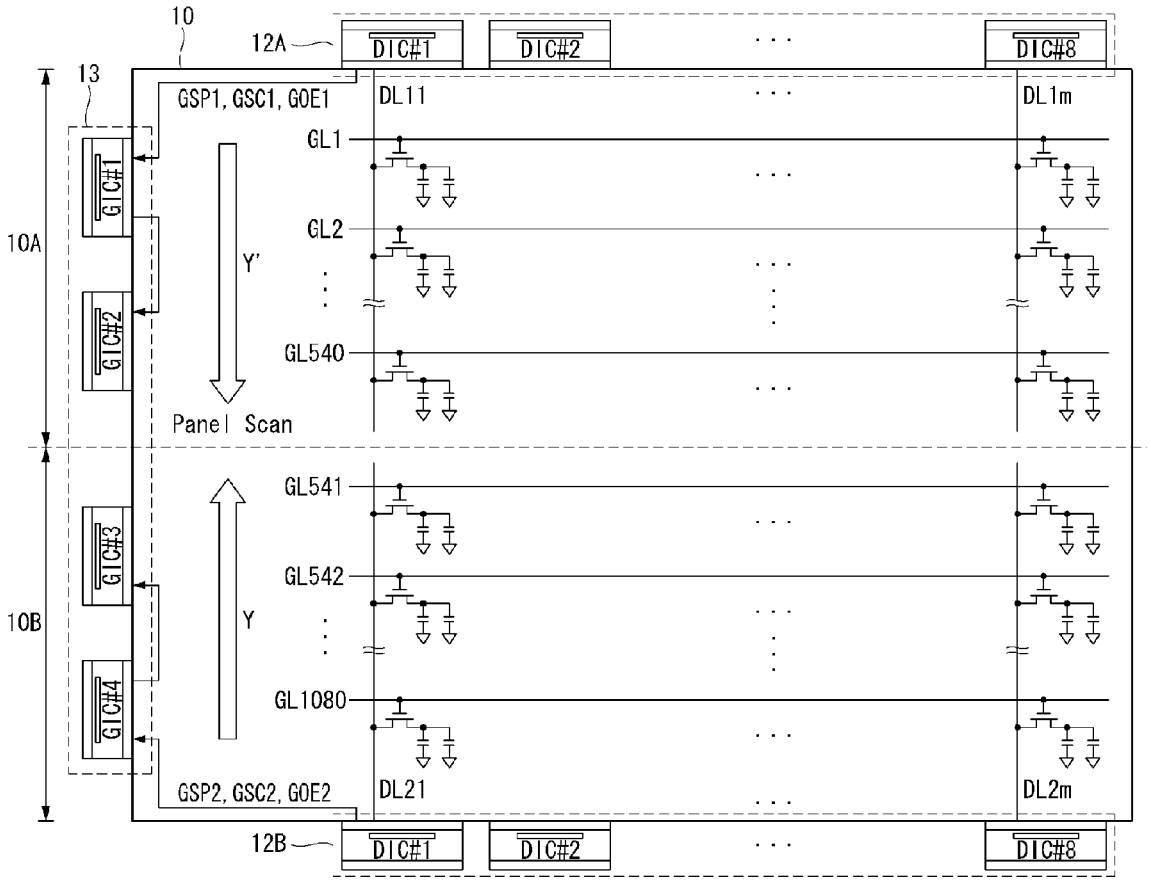
FIG. 4 illustrates driving circuits and a liquid crystal display panel according to the exemplary embodiment of the invention.

As shown in FIG. 4, the data driving circuit 12, includes a first data driving circuit 12A for driving data lines DL11 to DL1*m* of the first display surface 10A and a second data driving circuit 12B for driving data lines DL21 to DL2*m* of the second display surface 10B. The data lines DL11 to DL1*m* of the first display surface 10A are electrically separated from the data lines DL21 to DL2*m* of the second display surface 10B by a boundary between the first and second display surfaces 10A and 10B.

Each of the first and second data driving circuits 12A and 12B includes a plurality of data driver integrated circuits (ICs) DIC#1 to DIC#8. Each of the data driver ICs DIC#1 to DIC#8 includes a shift register for sampling a clock, a register for temporarily storing unit frame data RGB received from the timing controller 11, a latch that stores data corresponding to one line in response to the clock received from the shift register and simultaneously outputs each data corresponding to one line, a digital-to-analog converter (DAC) that selects a positive or negative gamma voltage based on a gamma reference voltage corresponding to digital data received from the latch to generate a positive or negative data voltage using the positive/negative gamma voltage, a multiplexer for selecting the data line DL receiving the positive/negative data voltage, an output buffer connected between the multiplexer and the data lines DL, and the like.

The first data driving circuit 12A latches unit frame data RGB to be displayed on the first display surface 10A under the control of the timing controller 11 and converts the latched unit frame data RGB into the positive/negative data voltage to supply the positive/negative data voltage to the data lines DL11 to DL1*m* of the first display surface 10A. The second data driving circuit 12B latches unit frame data RGB to be displayed on the second display surface 10B under the control of the timing controller 11 and converts the latched unit frame data RGB into the positive/negative data voltage to supply the positive/negative data voltage to the data lines DL21 to DL2*m* of the second display surface 10B.

The gate driving circuit 13, includes a plurality of gate driver ICs GIC#1 to GIC#4. Each of the gate driver ICs GIC#1 to GIC#4 includes a shift register, a level shifter for converting an output signal of the shift register into a swing width suitable for a TFT drive of the liquid crystal cells, an output buffer, and the like. The first and second gate driver ICs GIC#1 and GIC#2 performing a scanning operation on the first display surface 10A sequentially output a gate pulse (or a scan pulse) under the control of the timing controller 11 to sequentially supply the gate pulse to gate lines GL1 to GL540 of the first display surface 10A along the Y' direction shown in FIG. 4. The third and fourth gate driver ICs GIC#3 and GIC#4 performing a scanning operation on the second display surface 10B sequentially output a gate pulse (or a scan pulse) under the control of the timing controller 11 to sequentially supply the gate pulse to the gate lines GL541 to GL1080 of the second display surface 10B along the Y direction shown in FIG. 4.

The scanning operation of the first display surface 10A and the scanning operation of the second display surface 10B are simultaneously performed in a direction facing each other. The data voltage, that is supplied to the data lines DL11 to DL1*m* of the first display surface 10A in synchronization with the scanning operation of the first display surface 10A, is applied to liquid crystal cells of the first display surface 10A. Further, the data voltage, that is supplied to the data lines DL21 to DL2*m* of the second display surface 10B in synchronization with the scanning operation of the second display surface 10B, is applied to liquid crystal cells of the second display surface 10B.

The timing controller 11 receives timing signals Vsync, Hsync, DE, and DCLK from an external system board to generate timing control signals DDC, GDC1, and GDC2 for controlling operation timings of the first and second data driving circuits 12A and 12B and operation timing of the gate driving circuit 13 based on the timing signals Vsync, Hsync, DE, and DCLK.

The data control signal DDC for controlling the operation timings of the first and second data driving circuits 12A and 12B includes a source start pulse SSP, a source sampling clock SSC, a source output enable signal SOE, a polarity control signal POL, and the like. The source start pulse SSP indicates a location of the liquid crystal cell Clc where effective data is applied during one horizontal period. The source sampling clock SSC indicates a latch operation of data in the first and second data driving circuits 12A and 12B based on a rising or falling edge. The source output enable signal SOE indicates outputs of the first and second data driving circuits 12A and 12B. The polarity control signal POL indicates a polarity of the data voltage to be supplied to the liquid crystal cells Clc of the liquid crystal display panel 10.

The first gate control signal GDC1 for controlling the operation timing of the gate driving circuit 13 includes a first gate start pulse GSP1, a first gate shift clock GSC1, a first gate output enable signal GOE1, and the like. The first gate start pulse GSP1 indicates a scan start horizontal line (for example, a first horizontal line in FIG. 4) corresponding to a scan start line of the first display surface 10A during one vertical period in which one screen is displayed. The first gate start pulse GSP1 has a first direction value. The first gate shift clock GSC1 is a timing control signal for sequentially shifting the first gate start pulse GSP1 in the Y' direction depending on the first direction value and has a pulse width corresponding to an on-period of the thin film transistor TFT. The first gate output enable signal GOE1 determines an output of the gate pulse. The first gate control signal GDC1 is applied to the first and second gate driver ICs GIC#1 and GIC#2 scanning the first display surface 10A through line-on-glass (LOG) lines formed in a non-display portion of the lower glass substrate.

The second gate control signal GDC2 for controlling the operation timing of the gate driving circuit 13 includes a second gate start pulse GSP2, a second gate shift clock GSC2, a second gate output enable signal GOE2, and the like. The second gate start pulse GSP2 indicates a scan start horizontal line (for example, a 1080-th horizontal line in FIG. 4) corresponding to a scan start line of the second display surface 10B during one vertical period in which one screen is displayed. The second gate start pulse GSP2 has a second direction value opposite the first direction value and is generated simultaneously with the first gate start pulse GSP1. The second gate shift clock GSC2 is a timing control signal for sequentially shifting the second gate start pulse GSP2 in the Y direction depending on the second direction value. The second gate shift clock GSC2 has a pulse width corresponding to an on-period of the thin film transistor TFT and is synchronized with the first gate shift clock GSC1. The second gate output enable signal GOE2 determines an output of the gate pulse. The second gate control signal GDC2 is applied to the third and fourth gate driver ICs GIC#3 and GIC#4 scanning the second display surface 10B through line-on-glass (LOG) lines formed in a non-display portion of the lower glass substrate.

The timing controller 11 multiplies the data control signal DDC and the first and second gate control signals GDC1 and GDC2 to control operations of the first and second data driving circuits 12A and 2B and the gate driving circuit 13 using a frame frequency of (120×N) Hz, where N is a positive integer equal to or greater than 2. For example, a frame frequency is 240 Hz when N is 2. The multiplication operation of the frame frequency may be performed by an external system circuit.

The timing controller 11 time-divides a unit frame period into a first sub-frame period and a second sub-frame period. The timing controller 11 copies the unit frame data RGB received from a system circuit every unit frame period using a frame memory. Then, the timing controller 11 synchronizes the original unit frame data RGB and the copied unit frame data RGB with the multiplied frame frequency to repeatedly supply the same frame data to the first and second data driving circuits 12A and 12B during the first and second sub-frame periods. In other words, in a unit frame period, the original unit frame data RGB is displayed on the screen during the first sub-frame period, and the copied unit frame data RGB is displayed on the screen during the second sub-frame period.

A unit frame data includes interpolation frames and input frame data provided from the video source. Here, the unit frame data can be modulated to have a unit frame frequency that is higher than the input frame frequency in a system circuit or the timing controller 11. For example, the input frame data with a frequency of 60 Hz can be modulated into a unit frame data with a frame frequency of 120 Hz by inserting one interpolation frame for each input frame data. Alternatively, the input frame data with a frequency of 60 Hz can be modulated into a unit frame data with a frame frequency of 75 Hz by inserting one interpolation frame for every four input frame data.

The backlight unit 18 may be implemented as one of an edge type backlight unit and a direct type backlight unit. Because the embodiment of the invention drives the light sources in a blinking manner so as to improve a motion picture response time (MPRT) performance, the formation location of the light sources constituting the backlight unit are not limited. Although FIG. 3 shows an edge type backlight unit, the embodiment of the invention is not limited to the edge type backlight unit and may use any known backlight unit. The edge type backlight unit 18 includes a light guide plate 17, the plurality of light sources 16 irradiating light onto the side of the light guide plate 17, and a plurality of optical sheets stacked (not shown) between the light guide plate 17 and the liquid crystal display panel 10.

Figure 5A:
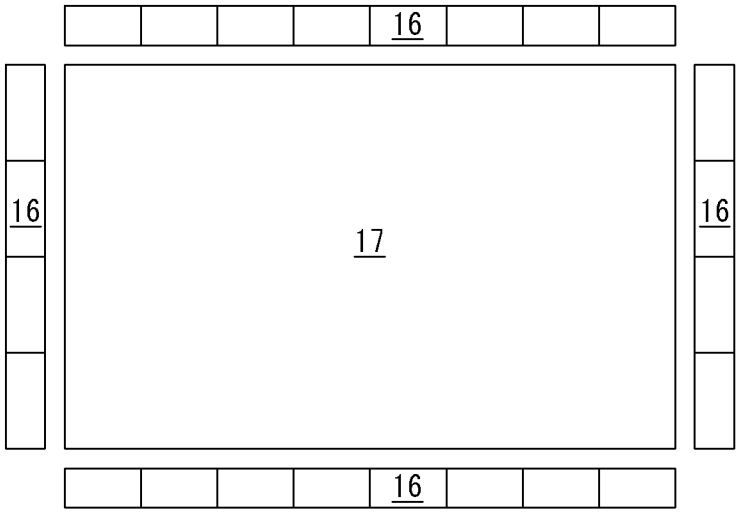
FIGS. 5A to 5D illustrate locations of light sources of a backlight unit according to the exemplary embodiment of the invention.
Figure 5B:
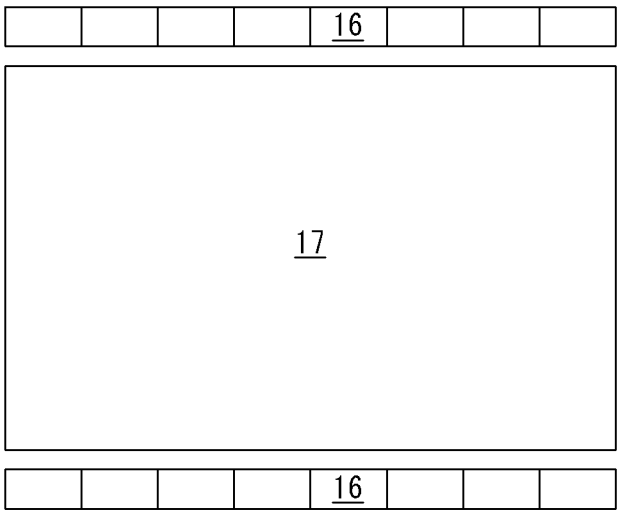
Figure 5C:
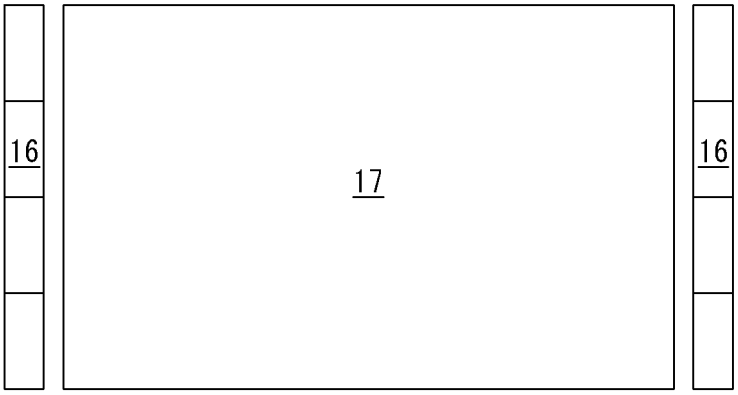
Figure 5D:
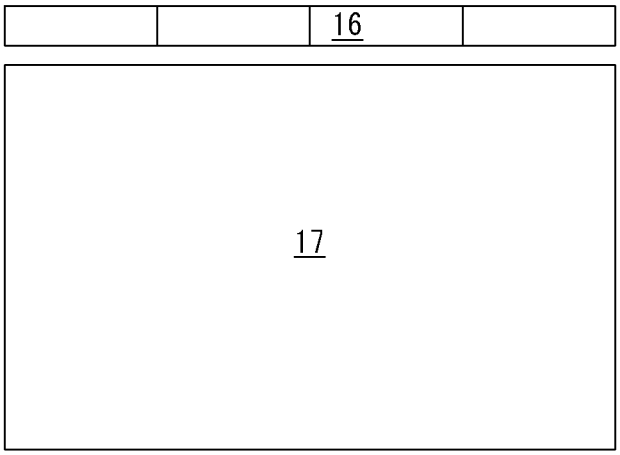

In the edge type backlight unit according to an exemplary embodiment of the invention, the light sources 16 may be positioned at least one side of the light guide plate 17. For example, the light sources 16 may be positioned at four sides of the light guide plate 17 as shown in FIG. 5A or may be positioned at upper and lower sides of the light guide plate 17 as shown in FIG. 5B. Alternatively, the light sources 16 may be positioned at right and left sides of the light guide plate 17 as shown in FIG. 5C or may be positioned at one side of the light guide plate 17 as shown in FIG. 5D. The light sources 16 may be implemented as one of a cold cathode fluorescent lamp (CCFL), an external electrode fluorescent lamp (EEFL), and a light emitting diode (LED). Preferably, the light sources 16 may be implemented as the LED whose a luminance immediately varies depending on an adjustment of a driving current. The light guide plate 17 may have at least one of various types of patterns including a plurality of depressed patterns or embossed patterns, prism patterns, and lenticular patterns, and the at least one of the various types of patterns is formed on an upper surface and/or a lower surface of the light guide plate 17. The patterns of the light guide plate 17 may secure rectilinear propagation of a light path and may control a brightness of the backlight unit 18 in each local area. The optical sheets include at least one prism sheet and at least one diffusion sheet to diffuse light from the light guide plate 17 and to refract the travel path of light traveling substantially perpendicular to the light incident surface of the liquid crystal display panel 10. The optical sheets may include a dual brightness enhancement film (DBEF).

The light source control circuit 14 generates the light source control signal LCS including a pulse width modulation (PWM) signal for controlling turn-on time of the light sources 16 and a current control signal for controlling a driving current of the light sources 16. A maximum duty ratio of the PWM signal may be previously set within a range equal to or less than 50%, so that the MPRT performance can be improved. A level of the driving current of the light sources 16 may be previously set, so that the level of the driving current is inversely proportional to the maximum duty ratio of the PWM signal. More specifically, as the maximum duty ratio of the PWM signal decreases, the level of the driving current increases. The inversely proportional relationship between the maximum duty ratio of the PWM signal and the level of the driving current is to compensate for a reduction in a luminance of the screen resulting from an increase in turn-off time of the light sources 16 in a unit frame period for improving the MPRT performance. The driving currents, each having a different level depending on the maximum duty ratio of the PWM signal, are described later with reference to FIG. 9. A duty ratio of the PWM signal may vary depending on an input image within a range equal to or less than the previously set maximum duty ratio. In this case, the light source control circuit 14 analyzes the input image and adjusts the duty ratio of the PWM signal according to the result of an analysis of the input image to thereby perform global dimming or local dimming. During the global or local dimming, the light source control circuit 14 adjusts the duty ratio of the PWM signal and modulates the input data thereby expanding a dynamic range of the input image. The light source control circuit 14 may be mounted inside the timing controller 11.

The light source control signal LCS includes turn-on times and turn-off times of the light sources 16. The turn-on times of the light sources 16 may vary depending on the duty ratio of the PWM signal after the liquid crystals are saturated. The turn-off times of the light sources 16 may be fixed to be immediately before the time in which data of the next frame is written in the middle portion of the first display surface 10A and the middle portion of the second display surface 10B.

The light source driving circuit 15 turns off all of the light sources 16 during the first sub-frame period and turns on all of the light sources 16 during the second sub-frame period in response to the light source control signal LCS to thereby blinkingly drive the light sources 16.

Figure 6:
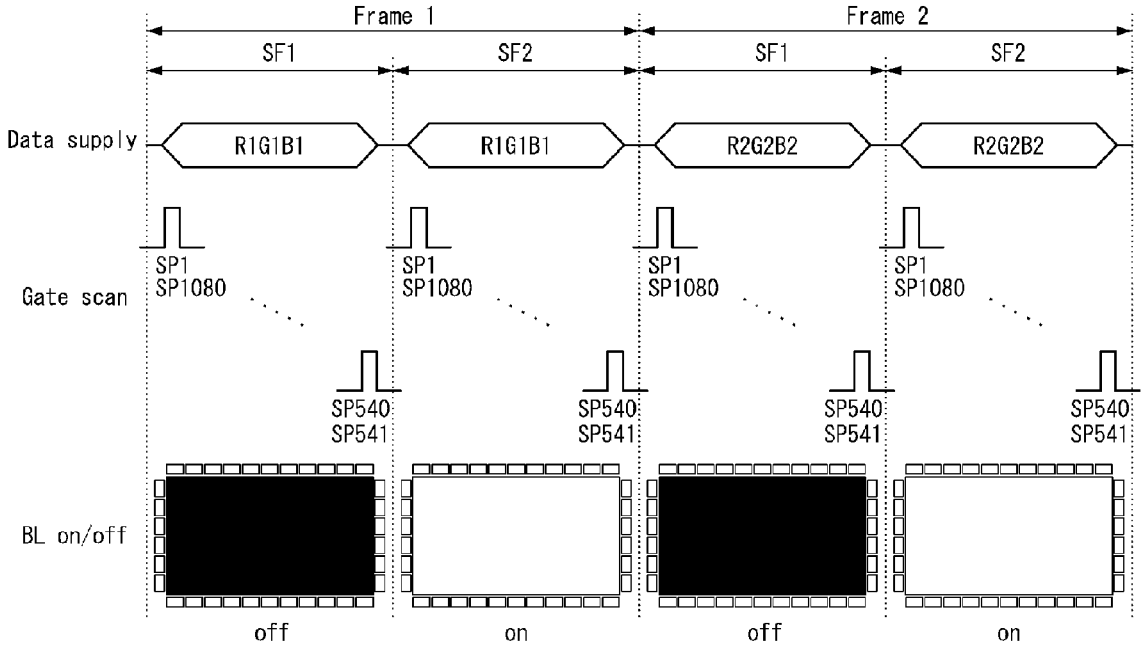
FIGS. 6 to 8 illustrate data write and turn-on times and turn-off times of light sources for improving a motion picture response time (MPRT) performance according to the exemplary embodiment of the invention.
Figure 7:
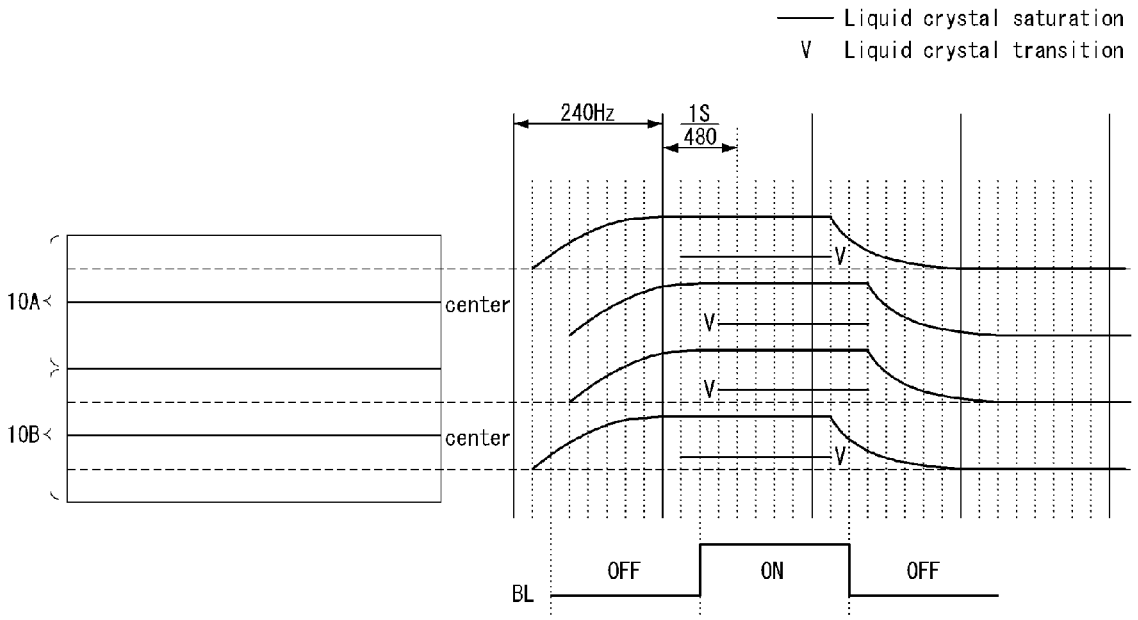
Figure 8:
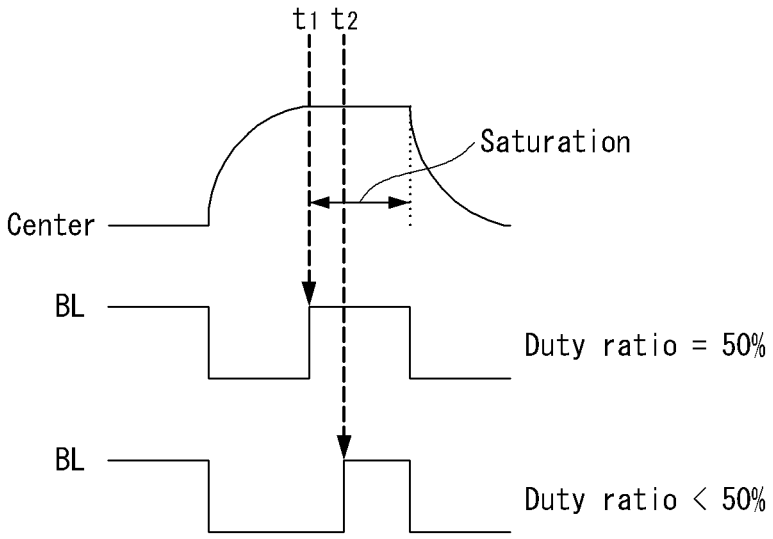

FIGS. 6 to 8 illustrate data write and turn-on time and turn-off time of the light sources for improving the MPRT performance.

As shown in FIG. 6, the exemplary embodiment of the invention controls the data driving circuits and the gate driving circuit using a frame frequency obtained by multiplying an input frame frequency by 2 to thereby time-division drive a unit frame period into a first sub-frame period SF1 and a second sub-frame period SF1. Original data corresponding to one frame is dividedly displayed simultaneously on the first and second display surfaces 10A and 10B during the first sub-frame period SF1, and copied data (equal to the original data) corresponding to one frame is dividedly displayed simultaneously on the first and second display surfaces 10A and 10B during the second sub-frame period SF2. The light sources remain in a turn-off state during the first sub-frame period SF1 and then are turned on during the second sub-frame period SF2.

To reduce a difference between saturation time of the liquid crystals in the entire display surface of the liquid crystal display panel 10 and the turn-on time of the light sources 16, the turn-on time of the light sources 16 can be set based on saturation time of liquid crystals in a middle portion of the first or second display surface. The saturation order of the liquid crystals is determined depending on the scanning order of the display surface of the liquid crystal display panel 10. More specifically, supposing that the display surface of the liquid crystal display panel 10 is sequentially scanned from the top to the bottom of the display surface, liquid crystals in an uppermost portion of the display surface and liquid crystals in a lowermost portion of the display surface are saturated at a time difference (for example, $1/120$ sec) corresponding to (1/frame frequency). In the exemplary embodiment of the invention, the frame frequency is multiplied by 2 through frequency multiplication so as to reduce the time difference. Further, the gate pulse is simultaneously applied in both directions from the top and the bottom of the display surface of the liquid crystal display panel 10 to write data. As a result, a maximum saturation time difference between the liquid crystals of the display surface is $1/480$ sec as shown in FIG. 7 and is reduced to $1/4$ of an existing maximum saturation time difference. Thus, even if the turn-on time of the light sources 16 is set based on any time point, a difference between the saturation time of liquid crystals depending on a location and the turn-on time of the light sources 16 is greatly reduced because of the reduction in the maximum saturation time difference between the liquid crystals. In the exemplary embodiment of the invention, the turn-on time of the light sources 16 is set based on one of saturation time of liquid crystals in the middle portion of the first display surface 10A and saturation time of liquid crystals in the middle portion of the second display surface 10B as shown in FIG. 7. Here, the saturation time of the liquid crystals in the middle portion of the first display surface 10A is equal to the saturation time of the liquid crystals in the middle portion of the second display surface 10B because of the scanning operation of the display surface in the both directions. As a result, even if the light sources 16 are turned on through the PWM signal having a maximum duty ratio of 50%, all of the liquid crystals of the display surface remain in a saturation state during a period equal to or greater than ¾ of the turn-on period of the light sources 16.

As shown in FIG. 8, the turn-on time of the light sources may vary depending on the maximum duty ratio of the PWM signal in the second sub-frame period SF2. For example, the turn-on time of the light sources may be determined as a first time point t1 so as to achieve a maximum duty ratio of 50% and may be determined as a second time point t2 later than the first time point t1 so as to achieve a maximum duty ratio smaller than 50%.

Figure 9:
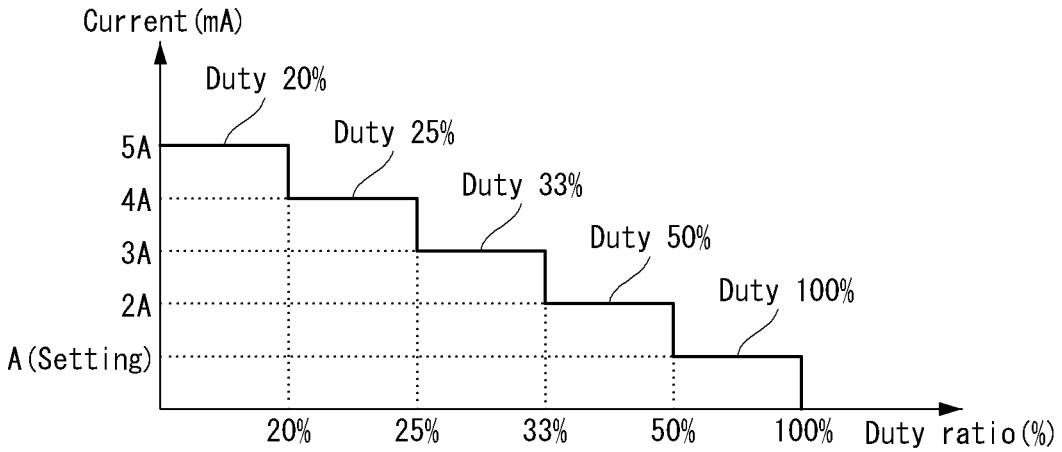
FIG. 9 illustrates levels of a driving current varying depending on a duty ratio of a pulse width modulation (PWM) signal according to the exemplary embodiment of the invention.

FIG. 9 illustrates variation of levels of the driving current depending on the maximum duty ratio of the PWM signal to compensate for a luminance reduction in the blinking manner. As shown in FIG. 9, a level of the driving current is inversely proportional to the maximum duty ratio of the PWM signal. For example, when the reference current level A is defined to be the current level when maximum duty ration of the PWM is 100%, the level of the driving current may be set at a value (i.e., 2A) corresponding to two times the reference current level A when the maximum duty ratio of the PWM signal is 50%; a value (i.e., 3A) corresponding to three times the reference current level A when the maximum duty ratio of the PWM signal is 33%; a value (i.e., 4A) corresponding to four times the reference current level A when the maximum duty ratio of the PWM signal is 25%; and a value (i.e., 5A) corresponding to five times the reference current level A when the maximum duty ratio of the PWM signal is 20%. In FIG. 9, the reference current level A, which is the current level corresponding to 100% maximum duty ratio of the PWM signal, is previously stored in a specific register of the light source control circuit 14.

Figure 10:
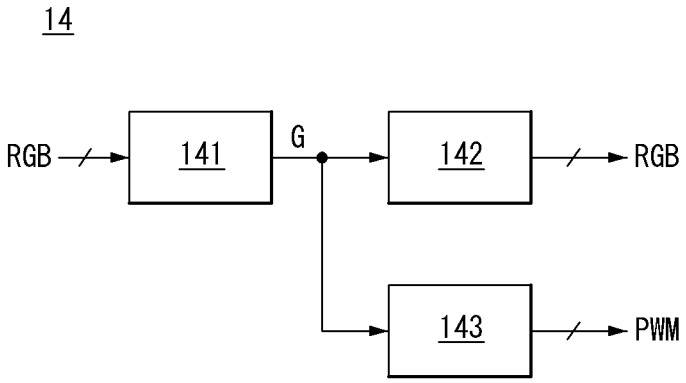
FIG. 10 illustrates a configuration of a light source control circuit according to the exemplary embodiment of the invention.

FIG. 10 illustrates a configuration of the light source control circuit 14 for improving the MPRT performance and performing global diming or local diming. As shown in FIG. 10, the light source control circuit 14 includes an input image analysis unit 141, a data modulation unit 142, and a duty adjusting unit 143.

The input image analysis unit 141 calculates a histogram (i.e., a cumulative distribution function) of the data RGB of the input image and calculates a frame representative value from the histogram. The frame representative value may be calculated using a mean value, a mode value (indicating a value that occurs the most frequently in the histogram), etc. of the histogram. The frame representative value may be calculated based on the entire screen of the liquid crystal display panel 10 in the global dimming and may be calculated based on each of predetermined blocks in the local dimming. The input image analysis unit 141 determines a gain value G depending on the frame representative value. The gain value G is supplied to the data modulation unit 142 and the duty adjusting unit 143. The gain value G may be determined as a large value as the frame representative value increases and may be determined as a small value as the frame representative value decreases. The input image analysis unit 141 may determine a dimming value of each of the blocks depending on the frame representative value in the local dimming and then may calculate the gain value G of each of the blocks based on each dimming value.

The data modulation unit 142 modulates the input image data RGB based on the gain value G received from the input image analysis unit 141 to expand a dynamic range of data input to the liquid crystal display panel 10. As the gain value G received from the input image analysis unit 141 increases, an upward modulation width of the input image data RGB may increase. Further, as the gain value G received from the input image analysis unit 141 decreases, a downward modulation width of the input image data RGB may increase. A data modulation operation of the data modulation unit 142 may be performed using a look-up table.

The duty adjusting unit 143 may adjust the duty ratio of the PWM signal depending on the gain value G received from the input image analysis unit 141. The duty ratio of the PWM signal is determined as a value proportional to the gain value G within a range equal to or less than the previously set maximum duty ratio. The duty ratio of the PWM signal may be adjusted based on the entire screen of the liquid crystal display panel or based on each of the blocks.

As described above, in the liquid crystal display according to the embodiment of the invention, data is written in the liquid crystal display panel by simultaneously applying the gate pulse in both directions from the top and the bottom of the display surface of the liquid crystal display panel, the same data is repeatedly displayed during one frame period that is divided into the first and second sub-frame periods, and all of the light sources are turned off during the first sub-frame period and then are turned on during the second sub-frame period. Hence, a difference between the turn-on time of the light sources and the saturation time of the liquid crystals is greatly reduced irrespective of a location of the display surface of the liquid crystal display panel. Further, an increase in the driving current of the light sources compensates for a reduction in a lumination of the liquid crystal display panel resulting from the blinking manner. Hence, the liquid crystal display according to the embodiment of the invention can greatly improve the MPRT performance without luminance reduction and without light interference.

Furthermore, in the liquid crystal display and the method for driving the same according to the embodiment of the invention, because the light sources are blinkingly driven so as to improve the MPRT performance, it is possible to blinkingly drive the light sources even when an edge type backlight unit is used in the liquid crystal display according to the embodiment of the invention. The edge type backlight unit may be thinner than a direct type backlight unit in which a sufficient interval between light sources and a diffusion plate is required for light diffusion. Thus, the edge type backlight unit may contribute to the thin profile of the liquid crystal display.

It will be apparent to those skilled in the art that various modifications and variations can be made in the liquid crystal display of the present invention without departing from the spirit or scope of the invention. Thus, it is intended that the present invention cover the modifications and variations of this invention provided they come within the scope of the appended claims and their equivalents.

What is claimed is:

1. A liquid crystal display comprising:

a liquid crystal display panel that is divided into a first display surface and a second display surface including data lines and gate lines;

a first data driving circuit configured to drive data lines of the first display surface;

a second data driving circuit configured to drive data lines of the second display surface;

a gate driving circuit configured to sequentially supply a gate pulse for scanning the first display surface to gate lines of the first display surface and sequentially supply a gate pulse for scanning the second display surface to gate lines of the second display surface;

a timing controller configured to divide a unit frame period into a first sub-frame period and a second sub-frame period, and configured to copy an input data to generate a copied data;

a backlight unit configured to provide light to the liquid crystal display panel wherein the backlight unit includes a plurality of light sources; and a light source driving circuit configured to turn off simultaneously all the plurality of light sources during the first sub-frame period and turn on simultaneously all the plurality of light sources at a turn-on time within the second sub-frame period, wherein the input data is displayed on the first and second display surfaces during the first sub-frame period, and the copied data equal to the input data is displayed on the first and second display surfaces during the second sub-frame period, wherein the turn-on time of all the plurality of light sources is set based on one of saturation time of liquid crystals in a middle portion of the first display surface and saturation time of liquid crystals in a middle portion of the second display surface, and wherein the timing controller synchronizes the input data and the copied data with a frame frequency of (unit frame frequency)×N to repeatedly display the input data and the copied data on the liquid crystal display panel during the first and second sub-frame periods for reducing a difference between the turn-on time of the light sources and the saturation time of the liquid crystals, where N is a positive integer equal to or greater than 2.

2. The liquid crystal display in claim 1, wherein the timing controller controls an operation timing of the first data driving circuit, the second data driving circuit, and the gate driving circuit using a frame frequency greater than a unit frame frequency.

3. The liquid crystal display in claim 2, wherein the unit frame frequency is equal to or greater than 75 Hz.

4. The liquid crystal display in claim 1, wherein the timing controller controls an operation timing of the first data driving circuit, the second data driving circuit, and the gate driving circuit using a frame frequency of (unit frame frequency)×N, where N is a positive integer equal to or greater than 2.

5. The liquid crystal display in claim 1, wherein the backlight unit is an edge type backlight unit wherein the plurality of light sources are disposed at at least one side of a light guide plate within the backlight unit.

6. The liquid crystal display in claim 1, wherein the backlight unit is a direct type backlight unit.

7. The liquid crystal display in claim 1, wherein the turn-on time depends on a duty ratio of a pulse width modulation signal after the liquid crystals in a middle portion of the first display surface or the second display surface is saturated in response to a unit frame data.

8. The liquid crystal display in claim 1, wherein the backlight includes a light guide plate having one of a plurality of depressed patterns, embossed patterns, prism patterns, and lenticular patterns.

9. The liquid crystal display in claim 1, wherein a level of a driving current driving the plurality of light sources is inversely proportional to a maximum duty ratio of a pulse width modulation signal output from a light source control circuit.

10. The liquid crystal display in claim 1, wherein the turn-on time of the plurality of light sources is delayed as a maximum duty ratio of a pulse width modulation signal decreases.

11. The liquid crystal display in claim 1, wherein a scanning direction of the first display surface and a scanning direction of the second display surface are opposite to each other.

12. The liquid crystal display in claim 1, further comprising a light source control circuit configured to generate a pulse width modulation signal to control the turn-on time of the plurality of light sources.

13. The liquid crystal display in claim 12, wherein the light source control circuit comprises:

a data analysis unit configured to calculate a frame representative value;

a data modulation unit configured to modulate a unit frame data based on the frame representative value; and a duty adjusting unit configured to adjust a duty ratio of the pulse width modulation signal based on the frame representative value.

14. The liquid crystal display in claim 13, wherein the unit frame data includes an input frame data and an interpolation frame data and the unit frame frequency.

15. A method of driving a liquid crystal display comprising:

providing light to a liquid crystal display panel that is divided into a first display surface and a second display surface including data lines and gate lines wherein the liquid crystal display panel includes a backlight unit having a plurality of light sources;

dividing a unit frame period into a first sub-frame period and a second sub-frame period, and copying an input data to generate a copied data with a timing controller;

displaying the input data on the first and second display surfaces during the first sub-frame period, and displaying the copied data equal to the input data on the first and second display surfaces during the second sub-frame period; and turning off simultaneously all the plurality of light sources during the first sub-frame period and turning on simultaneously all the plurality of light sources at a turn-on time within the second sub-frame period with a light source driving circuit, wherein the turn-on time of all the plurality of light sources is set based on one of saturation time of liquid crystals in a middle portion of the first display surface and saturation time of liquid crystals in a middle portion of the second display surface, and wherein the timing controller synchronizes the input data and the copied data with a frame frequency of (unit frame frequency)×N to repeatedly display the input data and the copied data on the liquid crystal display panel during the first and second sub-frame periods for reducing a difference between the turn-on time of the light sources and the saturation time of the liquid crystals, where N is a positive integer equal to or greater than 2.

16. The method in claim 15, wherein a level of a driving current driving the plurality of light sources is inversely proportional to a maximum duty ratio of a pulse width modulation signal output from a light source control circuit.

17. The method in claim 15, wherein the turn-on time of the plurality of light sources is delayed as a maximum duty ratio of a pulse width modulation signal decreases.

18. The method in claim 15, further comprising generating a pulse width modulation signal to control the turn-on time of the plurality of light sources with a light source control circuit.

19. The method in claim 15, further comprising:

calculating a frame representative value based on data provided to either an entire screen of the liquid crystal display panel or a portion of the liquid crystal display panel; and adjusting a duty ratio of a pulse width modulation signal based on the frame representative value.

* * * * *